US005698046A

United States Patent [19]

St. Laurent et al.

[11] Patent Number: 5,698,046

[45] Date of Patent: Dec. 16, 1997

[54] AUTOMATIC DISHWASHING DETERGENT WITH ALKOXY OR ARYLOXY AMIDE SURFACTANT

[75] Inventors: James Charles Theophile Roger Burckett St. Laurent; Daniel Stedman Connor, both of Cincinnati; Yi-Chang Fu, Wyoming; Jeffrey John Scheibel, Cincinnati; William Michael Scheper, Fairfield, all of Ohio

[73] Assignee: The Procter & Gamble Comapny, Cincinnati, Ohio

[21] Appl. No.: 660,501

[22] Filed: Jun. 7, 1996

Related U.S. Application Data

[63] Continuation of Ser. No. 278,859, Jul. 26, 1994, abandoned, which is a continuation-in-part of Ser. No. 119,259, Sep. 9, 1993, abandoned.

[51] Int. Cl.[6] ..... B08B 3/02; B08B 3/024; C11D 3/32

[52] U.S. Cl. ..... 134/25.2; 510/220; 510/221; 510/224; 510/378; 510/379; 510/502

[58] Field of Search ..... 134/25.2; 510/220, 510/221, 224, 378, 379, 502

[56] References Cited

U.S. PATENT DOCUMENTS

| | | | |
|---|---|---|---|
| 1,985,424 | 12/1934 | Piggott et al. | 260/124 |
| 2,016,962 | 10/1935 | Flint et al. | 260/127 |
| 2,653,932 | 9/1953 | Schwartz | 260/211 |
| 2,703,798 | 3/1955 | Schwartz | 260/211 |
| 2,965,576 | 12/1960 | Wilson | 252/137 |
| 3,654,166 | 4/1972 | Eckert et al. | 252/117 |
| 3,764,531 | 10/1973 | Eckert et al. | 252/8.8 |
| 5,174,927 | 12/1992 | Honsa | 252/543 |
| 5,188,769 | 2/1993 | Connor et al. | 252/548 |
| 5,194,639 | 3/1993 | Connor et al. | 554/66 |
| 5,283,009 | 2/1994 | Speckman et al. | 252/548 |
| 5,318,728 | 6/1994 | Surutzidis et al. | 252/548 |

FOREIGN PATENT DOCUMENTS

| | | |
|---|---|---|
| 170900 A | 7/1990 | Japan . |
| HEI 3-246265 | 11/1991 | Japan . |
| WO 92/05764 | 4/1992 | WIPO . |
| WO 92/06150 | 4/1992 | WIPO . |
| WO 92/06151 | 4/1992 | WIPO . |
| WO 92/06171 | 4/1992 | WIPO . |
| WO92/06155 | 4/1992 | WIPO . |

OTHER PUBLICATIONS

PCT Search Report dated Aug. 2, 1995.

*Primary Examiner*—Ardith Hertzog
*Assistant Examiner*—Gregory R. Delcotto
*Attorney, Agent, or Firm*—Jerry J. Yetter; Jacobus C. Rasser

[57] ABSTRACT

Automatic dishwashing detergents containing N-alkoxy or N-aryloxy polyhydroxy fatty acid amide surfactants which provide not only improved cleaning, but also improved filming and spotting performance on tableware are described. Thus, $C_{12}$–$C_{14}$ N-(3-methoxypropyl) glucamide is used in automatic dishwashing compositions which, optionally, can be formulated to be free from chlorine bleach or phosphate builders. Weak builders such as citrate and perborate or percarbonate bleach can be used in the compositions, as can various detersive enzymes.

1 Claim, No Drawings

AUTOMATIC DISHWASHING DETERGENT WITH ALKOXY OR ARYLOXY AMIDE SURFACTANT

CROSS-REFERENCE TO RELATED APPLICATION

This is a continuation of application Ser. No. 08/278,859, filed on Jul. 26, 1994 which is a continuation-in-part of application Ser. No. 08/119,259, filed Sep. 9, 1993, now abandoned.

TECHNICAL FIELD

The present invention is in the field of automatic dishwashing detergents. More specifically, the invention relates to the use of N-alkoxy or N-aryloxy polyhydroxy fatty acid amide surfactants which provide cleaning and filming/spotting benefits on dishware. Various forms of the compositions are disclosed, as is a method of washing tableware, such as dishes, glassware, cups and flange with the compositions.

BACKGROUND OF THE INVENTION

Automatic dishwashing detergents (ADD's) used for washing tableware in the home or institutionally in machines especially desired for the purpose have long been known. The particular requirements of cleansing tableware and leaving it in a sanitary, essentially spotless, residue-free state has indeed resulted in so many particular ADD compositions that the body of art pertaining thereto is now recognized as quite distinct from other cleansing product arts.

In light of legislation and current enviromental trends, modem ADD products are desirably substantially free of inorganic phosphate builder salts. Unfortunately, nonphosphated ADD products may be made available to the consumer with a promise of effectiveness, but in technical terms they may sacrifice efficacy, especially owing to the deletion of phosphate and, in some versions, deletion of chlorine bleach mainstay cleansing ingredients. Without being limited by theory, stain removal shortcomings in particular are due to commercial nonphosphate or nonphosphate/nonchlorine ADD products relying quite heavily on a robust product matrix which may be lost unless very expensive, high levels of nonphosphorus builders are used.

In addition to cleaning performance, users of ADD's have come to expect that tableware will be rendered essentially spotless and film-free. Accordingly, compositions which merely cleanse tableware but do not provide adequate spotting/filming performance are unacceptable. As another complicating factor, the formulator must employ ingredients which are sufficiently soluble that residues of the ADD product do not remain in the automatic dishwashing machine after use. Again, while some ingredients may be adequate for cleaning, spotting and filming, solubility considerations may diminish their usefulness. Solubility considerations are even more accute with the newer "high density", "low usage" ADD compositions whose overall solubility inherently tends to be less than that of low density granular products.

It has now been determined that the N-alkoxy and N-aryloxy polyhydroxy fatty acid amide surfactants are of considerable benefit to formulators of ADD compositions. Alkoxy and aryloxy substituted polyhydroxy fatty acid amide surfactants substantially reduce interfacial tensions, and thus provide high cleaning performances. These surfactants also function well in the presence of water hardness cations, such as calcium and magnesium ions. This means that ADD compositions can be more effective even in the absence of phosphate builders. It has also been found that such surfactants exhibit better dissolution in water than many other classes of surfactants, thereby helping to alleviate the residue problem mentioned above. In addition, it has now been determined that preferred members of the N-alkoxy and N-aryloxy polyhydroxy fatty acid amide class of surfactants exhibit unusual surface wetting and draining properties which are of substantial benefit with respect to filming/spotting of tableware. Moreover, the preferred N-alkoxy and N-aryloxy surfactants employed herein can be prepared using mainly renewable resources, rather than petrochemicals, and are biodegradable.

Accordingly, it is an object of the present invention to provide new and improved ADD compositions. Preferred compositions are nonphosphated, i.e., they are substantially free from, and unreliant on, inorganic phosphate builders. The compositions herein may optionally, but preferably, be formulated without chlorine bleach. It is another object herein to provide ADD's, especially granules, formulated with N-alkoxy or N-aryloxy polyhydroxy fatty acid amides plus adjunct ingredients to provide highly effective removal of stains from tableware and with improved overall appearance of said tableware, especially with regard to filming and spotting. Another object herein is to provide a method for washing tableware in home or institutional automatic dishwashing appliances, especially in home appliances, without leaving product residues in the appliances. The compositions herein can be formulated to provide low suds, which is a desirable feature for use in automatic machines in which sudsing can be problematic.

BACKGROUND ART

Japanese Kokai HEI 311991]-246265 Osamu Tachizawa, U.S. Pat. Nos. 5,194,639, 5,174,927 and 5,188,769 and WO 9,206,171, 9,206,151, 9,206,150 and 9,205,764 relate to various polyhydroxy fatty acid amide surfactants and uses thereof.

SUMMARY OF THE INVENTION

The present invention encompasses a method for cleaning soiled tableware comprising contacting said tableware with an aqueous medium comprising at least about 15 ppm, preferably from about 100 ppm to about 10,000 ppm, of an N-alkoxy or N-aryloxy polyhydroxy fatty acid amide surfactant in an automatic dishwashing machine. The preferred polyhydroxy fatty acid amide surfactant for use in the compositions and methods herein is a $C_{12}$–$C_{18}$ fatty acid amide of an N-alkoxy polyhydroxy amine, especially $C_{12}$–$C_{14}$ N-(3-methoxypropyl) glucamide.

The invention also encompasses an automatic dishwashing detergent composition which comprises:

(a) at least about 0.1%, preferably from about 1% to about 20%, by weight of an N-alkoxy or N-aryloxy polyhydroxy fatty acid amide surfactant;

(b) at least about 0.1%, preferably from about 5% to about 65%, by weight of a detergency builder;

(c) at least about 0.1%, preferably from about 1% to about 20%, by weight of a bleach;

(d) optionally, but preferably at least about 0.001%, typically from about 0.1% to about 5% by weight, one or more detersive enzymes;

(e) optionally, but preferably from about 0.1% to about 5% by weight, one or more low-sudsing surfactants other than those specified in (a);

(f) optionally, but preferably from about 1% to about 20% by weight, one or more organic dispersants;

(g) optional detersive adjuncts, suds-suppressors and pH-control agents which typically comprise from about 10% to about 60% by weight of the overall composition.

Preferred compositions herein are those wherein the detergency builder is a nonphosphate builder, especially citrate.

Other preferred compositions herein are those wherein the bleach is nonchlorine bleach, especially percarbonate or perborate.

A highly preferred composition herein comprises:

(a) from about 1% to about 10% by weight of a surfactant which is a member selected from the group consisting of the $C_{12}$–$C_{14}$ fatty acid amides of N-(3-methoxypropyl) glueamine, and mixtures thereof;

(b) from about 10% to about 60% by weight of a citrate builder;

(c) from about 3% to about 20% by weight of a bleach selected from perborate bleach and percarbonate bleach;

(d) from about 0% to about 7% by weight of a bleach activator;

(e) optionally, but preferably, from about 2% to about 10% by weight of a polyacrylate organic dispersant;

(f) from about 0.1% to about 7% by weight of an enzyme which is a member selected from the group consisting of proteases, lipases, amylases and mixtures thereof;

(g) from about 1% to about 7% by weight of a low-sudsing nonionic surfactant which is different from (a);

(h) at least about 0.2% by weight of a suds suppressor; and (i) a pH adjusting agent to provide an in-use pH greater than about pH 9.5.

In one mode, the compositions herein comprise from about 0.1% to about 5% by weight of a nonionic ethoxylate co-surfactant having a critical micelle concentration (c.m.c.; measured in water) of from about 0.5 ppm to about 50 ppm. In another mode, the compositions comprise from about 5% to about 10% of an anionic co-surfactant having a c.m.c. in water of from about 50 ppm to about 500 ppm.

The invention also encompasses a method for washing tableware, comprising contacting said tableware with an aqueous medium containing at least about 1,000 ppm of the aforesaid preferred composition in an automatic dishwasher.

All percentages, ratios and proportions herein are by weight, unless otherwise specified. All cited documents are incorporated herein by reference.

DETAILED DESCRIPTION OF THE INVENTION

The N-alkoxy and N-aryloxy polyhydroxy fatty acid amide surfactants used in the practice of this invention are quite different from traditional ethoxylated nonionics, due to the use of a linear polyhydroxy chain as the hydrophilic group instead of the ethoxylation chain. Conventional ethoxylated nonionic surfactants have cloud points with the less hydrophilic ether linkages. They become less soluble, more surface active and better performing as temperature increases, due to thermally induced randomness of the ethoxylation chain. When the temperature gets lower, ethoxylated nonionics become more soluble by forming micelles at very low concentration and are less surface active, and lower performing, especially when washing time is short.

In contrast, the polyhydroxy fatty acid amide surfactants have polyhydroxyl groups which are strongly hydrated and do not exhibit cloud point behavior. It has been discovered that they exhibit Kraffi point behavior with increasing temperature and thus higher solubility at elevated temperatures. They also have critical micelle concentrations similar to anionic surfactants, and it has been surprisingly discovered that they clean like anionics.

Moreover, the polyhydroxy fatty acid amides herein are different from the alkyl polyglycosides (APG) which comprise another class of polyhydroxyl nonionic surfactants. While not intending to be limited by theory, it is believed that the difference is in the linear polyhydroxyl chain of the polyhydroxy fatty acid amides vs. the cyclic APG chain which prevents close packing at interfaces for effective cleaning.

With respect to the N-alkoxy and N-aryloxy polyhydroxy fatty acid amides, such surfactants have now been found to have a much wider temperature usage profile than their N-alkyl counterparts, and they require no or little co-surfactants for solubility at temperatures as low as 5° C. Such surfactants also provide easier processing due to their lower melting points. It has now further been discovered that these surfactants are biodegradable.

As is well-known to formulators, most detergents are formulated with mainly anionic surfactants, with nonionics sometimes being used for grease/oil removal. Since it is well known that nonionic surfactants are far better for enzymes, polymers, soil suspension and skin mildness, it would be preferred that detergents use more nonionic surfactants. Unfortunately, traditional nonionics do not clean well enough in cooler water with short washing times.

It has now also been discovered that the N-alkoxy and N-aryloxy polyhydroxy fatty acid amide surfactants herein provide additional benefits over conventional nonionics, as follows:

a. Much enhanced stability and effectiveness of detersive enzymes;

b. Better water hardness tolerance;

c. The ability to incorporate higher levels of surfactants into finished product;

d. Better greasy soil removal; and e. The ability to formulate stable, high performance "All-Nonionic" or "High Nonionic/Low Anionic" compositions.

The N-alkoxy and N-aryloxy polyhydroxy fatty acid amide surfactants used herein comprise amides of the formula:

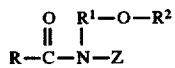

wherein: R is $C_7$–$C_{21}$ hydrocarbyl, preferably $C_9$–$C_{17}$ hydrocarbyl, including straight-chain (preferred), branched-chain alkyl and alkenyl, as well as substituted alkyl and alkenyl, e.g., 12-hydroxyoleic, or mixtures thereof; $R^1$ is $C_2$–$C_8$ hydrocarbyl including straight-chain, branched-chain and cyclic (including aryl), and is preferably $C_2$–$C_4$ alkylene, i.e., —$CH_2CH_2$—, —$CH_2CH_2CH_2$— and —$CH_2(CH_2)_2CH_2$—; and $R^2$ is $C_1$–$C_8$ straight-chain, branched-chain and cyclic hydrocarbyl including aryl and oxyhydrocarbyl, and is preferably $C_1$–$C_4$ alkyl or phenyl; and Z is a polyhydroxyhydrocarbyl moiety having a linear hydrocarbyl chain with at least 2 (in the case of glyceraldehyde) or at least 3 hydroxyls (in the case of other reducing sugars)

directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 1 to 5, inclusive, and R' is H or a cyclic mono- or poly- saccharide, and alkoxylated derivatives thereof. Most preferred are glycityls wherein n is 4, particularly $—CH_2—(CHOH)_4—CH_2OH$.

In compounds of the above formula, nonlimiting examples of the amine substituent group $—R^1—O—R^2$ can be, for example: 2-methoxyethyl-, 3-methoxypropyl-, 4-methoxybutyl-, 5-methoxypentyl-, 6-methoxyhexyl-, 2-ethoxyethyl-, 3-ethoxypropyl-, 2-methoxypropyl, methoxybenzyl-, 2-isopropoxyethyl-, 3-isopropoxypropyl-, 2-(t-butoxy)ethyl-, 3-(t-butoxy)propyl-, 2-(isobutoxy)ethyl-, 3-(isobutoxy)propyl-, 3-butoxypropyl, 2 -butoxyethyl, 2-phenoxyethyl-, methoxycyclohexyl-, methoxycyclohexylmethyl-, tetrahydrofurfuryl-, tetrahydropyranyloxyethyl-, 3-[2-methoxyethoxy]propyl-, 2-[2-methoxyethoxy]ethyl-, 3-[3-methoxypropoxy]propyl-, 2-[3-methoxypropoxy]ethyl-, 3 -[methoxypolyethyleneoxy] propyl-, 3-[4-methoxybutoxy]propyl-, 3-[2-methoxyisopropoxy]propyl-, $CH_3O-CH_2CH(CH_3—$ and $CH_3OCH_2CH(CH_3)CH_2—O—(CH_2)_3$.

R—CO—N< can be, for example, cocamide, stearamide, oleamide, lauramide, myristamide, capricamide, palmitamide, tallowamide, ricinolamide, etc.

While the synthesis of N-alkoxy or N-aryloxy polyhydroxy fatty acid amides can prospectively be conducted using various processes, contamination with cyclized by-products and other colored materials may be problematic. As an overall proposition, the synthesis method for these surfactants comprises reacting the appropriate N-alkoxy or N-aryloxy-substituted aminopolyols with, preferably, fatty acid methyl esters with or without a solvent using an alkoxide catalyst (e.g., sodium methoxide or the sodium salts of glycerin or propylene glycol) at temperatures of about 85° C. to provide the products having desirable low levels (preferably, less than about 10%) of ester amide or cyclized by-products and also with improved color and improved color stability, e.g., Gardner Colors below about 4, preferably between 0 and 2. If desired, any unreacted N-alkoxy or N-aryloxy amino polyol remaining in the product can be acylated with an acid anhydride, e.g., acetic anhydride, maleic anhydride, or the like, in water at 50° C.–85° C. to minimize the overall level of such residual amines in the product. Residual sources of straight-chain primary fatty acids, which can suppress suds, can be depleted by reaction with, for example, monoethanolamine at 50° C.–85° C. If desired, the water solubility of the N-alkoxy surfactants herein can be increased by "quick chilling" them from a melt. Thus, a melt of said surfactant can be cast onto a 0°–10° C. plate or roller which rapidly solidifies the melt into a highly soluble form.

By "cyclized by-products" herein is meant the undesirable reaction by-products of the primary reaction wherein it appears that the multiple hydroxyl groups in the polyhydroxy fatty acid amides can form ring structures. It will be appreciated by those skilled in the chemical arts that the preparation of the polyhydroxy fatty acid amides herein using the di- and higher saccharides such as maltose will result in the formation of polyhydroxy fatty acid amides wherein linear substituent Z (which contains multiple hydroxy substituents) is naturally "capped" by a polyhydroxy ring structure. Such materials are not cyclized by-products, as defined herein.

The following illustrates the syntheses in more detail.

Preparation of N-(2-methoxyethyl)glucamine

N-(2-methoxyethyl)-glucosylamine (sugar adduct) is prepared starting with 1728.26 g of 50 wt.% 2-methoxyethylamine in water (11.5 moles, 1.1 mole equivalent of 2-methoxyethylamine) placed under an $N_2$ blanket at 10° C. 2768.57 grams of 50 wt. % glucose in water (10.46 moles, 1 mole equivalent of glucose), which is degassed with $N_2$, is added slowly, with mixing, to the methoxyethylamine solution keeping the temperature below 10° C. The solution is mixed for about 40 minutes after glucose addition is complete. It can be used immediately or stored 0° C.–5° C. for several days.

About 278 g (~N15 wt. % based on amount of glucose used) of Raney Ni (Activated Metals & Chemicals, Inc. product A-S000) is loaded into a 2 gallon reactor (316 stainless steel baffled autoclave with DISPERSIMAX hollow shaft multi-blade impeller) with 4 L of water. The reactor is heated, with stirring, to 130° C. at about 1500 psig hydrogen for 30 minutes. The reactor is then cooled to room temperature and the water removed to 10% of the reactor volume under hydrogen pressure using an internal dip tube.

The reactor is vented and the sugar adduct is loaded into the reactor at ambient hydrogen pressure. The reactor is then purged twice with hydrogen. Stirring is begun, the reactor is heated to 50° C., pressurized to about 1200 psig hydrogen and these conditions are held for about 2 hours. The temperature is then raised to 60° C. for 10 minutes, 70° C. for 5 minutes, 80° C. for 5 minutes, 90° C. for 10 minutes, and finally 100° C. for 25 minutes.

The reactor is then cooled to 50° C. and the reaction solution is removed from the reactor under hydrogen pressure via an internal dip tube and through a filter in closed communication with the reactor. Filtering product under hydrogen pressure allows removal of any nickel particles without nickel dissolution.

Solid N-(2-methoxyethyl)glucamine is recovered by evaporation of water and excess 2-methoxyethylamine. The product purity is approximately 90% by G. C. Sorbitol is the major impurity at about 10%. The N-(2-methoxyethyl) glucamine can be used as is or purified to greater than 99% by recrystallization from methanol.

Preparation of $C_{12}$-N-(2-Methoxyethyl)glucamide

N-(2-methoxyethyl)-glueamine, 1195 g (5.0 mole; prepared according to Example I) is melted at 135° C. under nitrogen. A vacuum is pulled to 30 inches (762 mm) Hg for 15 minutes to remove gases and moisture. Propylene glycol, 21.1 g (0.28 mole) and fatty acid methyl ester (Procter & Gamble CE 1295 methyl ester) 1097 (5.1 mole) are added to the preheated amine. Immediately following, 25% sodium methoxide, 54 g (0.25 mole) is added in halves.

Reactants weight: 2367.1 g

Theoretical MeOH generated: (5.0×32)+(0.75×54)+(0.24×32)=208.5 g

Theory product: FW422 2110g 5.0mole

The reaction mixture is homogeneous within 2 minutes of adding the catalyst. It is cooled with warm $H_2O$ to 85° C.

and allowed to reflux in a 5-liter, 4-neck round bottom flask equipped with a heating mantle, Trubore stirrer with Teflon paddle, gas inlet and outlet, Thermowatch, condenser, and air drive motor. When catalyst is added, time=0. At 60 minutes, a GC sample is taken and a vacuum of 7 inches (178 mm) Hg is started to remove methanol. At 120 minutes, another GC sample is taken and the vacuum has been increased to 10 inches (254 mm) Hg. At 180 minutes, another GC sample is taken and the vacuum has been increased to 16 inches (406 mm) Hg. After 180 minutes at 85° C., the remaining weight of methanol in the reaction is 4.1% based on the following calculation: 2251 g current reaction wt.—(2367.1 g reactants wt.—208.5 g theoretical MeOH)/2251 g=4.1% MeOH remaining in the reaction. After 180 minutes, the reaction is bottled and allowed to solidify at least overnight to yield the desired product.

Preparation of N-(3-methoxypropyl)glucamine—About 300 g (about 15 wt. % based on mount of glucose used) of Raney Ni (Activated Metals & Chemicals, Inc. product A-5000 or A-5200) is contained in a 2 gallon reactor (316 stainless steel baffled autoclave with DISPERSIMAX hollow shaft multi-blade impeller) pressurized to about 300 psig with hydrogen at room temperature. The nickel bed is covered with water taking up about 10% of the reactor volume.

1764.8 g (19.8 moles, 1.78 mole equivalent) of 3-methoxypropylamine (99%) is maintained in a separate reservoir which is in closed communication with the reactor. The reservoir is pressurized to about 100 psig with nitrogen. 4000 g of 50 wt. % glucose in water (11.1 moles, 1 mole equivalent of glucose) is maintained in a second separate reservoir which is also in closed communication with the reactor and is also pressurized to about 100 psig with nitrogen.

The 3-methoxypropylamine is loaded into the reactor from the reservoir using a high pressure pump. Once all the 3-methoxypropylamine is loaded into the reactor, stirring is begun and the reactor heated to 60° C. and pressurized to about 800 psig hydrogen. The reactor is stirred at 60° C. and about 800 psig hydrogen for about 1 hour.

The glucose solution is then loaded into the reactor from the reservoir using a high pressure pump similar to the amine pump above. However, the pumping rate on the glucose pump can be varied and on this particular run, it is set to load the glucose in about 1 hour. Once all the glucose has been loaded into the reactor, the pressure is boosted to about 1500 psig hydrogen and the temperature maintained at 60° C. for about 1 hour. The temperature is then raised to 70° C. for 10 minutes, 80° C. for 5 minutes, 90° C. for 5 minutes, and finally 100° C. for 15 minutes.

The reactor is then cooled to 60° C. and the reaction solution is removed from the reactor under hydrogen pressure via an internal dip tube and through a filter in closed communication with the reactor. Filtering under hydrogen pressure allows removal of any nickel particles without nickel dissolution.

Solid N-(3-methoxypropyl)glucamine is recovered by evaporation of water and excess 3-methoxypropylamine. The product purity is approximately 90% by G. C. Sorbitol is the major impurity at about 3%. The N-(3-methoxypropyl) glucamine can be used as is or purified to greater than 99% by recrystallization from methanol.

Preparation of $C_{12}$N-(3-Methoxypropyl)glucamide

N-(3-methoxypropyl)-glucamine, 1265 g (5.0 mole prepared according to Example III) is melted at 140° C. under nitrogen. A vacuum is pulled to 25 inches (635 mm) Hg for 10 minutes to remove gases and moisture. Propylene glycol, 109 g (1.43 mole) and CE 1295 methyl ester, 1097 (5.1 mole) are added to the preheated amine. Immediately following, 25% sodium methoxide, 54 g (0.25 mole) is added in halves.

Reactants weight: 2525 g

Theoretical MeOH generated: (5.0×32)+(0.75×54)+(0.24×32)=208.5 g

Theory product: FW 436 2180 g 5.0 mole

The reaction mixture is homogeneous within 1 minute of adding the catalyst. It is cooled with warm $H_2O$ to 85° C. and allowed to reflux in a 5-liter, 4-neck round bottom flask equipped with a heating mantle, Trubore stirrer with Teflon paddle, gas inlet and outlet, Thermowatch, condenser, and air drive motor. When catalyst is added, time=0. At 60 minutes, a GC sample is taken and a vacuum of 7 inches (178 mm) Hg is started to remove methanol. At 120 minutes, another GC sample is taken and the vacuum has been increased to 12 inches (305 mm) Hg. At 180 minutes, another GC sample is taken and the vacuum has been increased to 20 inches (508 mm) Hg. After 180 minutes at 85° C., the remaining weight of methanol in the reaction is 2.9% based on the following calculation: 2386 g current reaction wt.—(2525 g reactants wt.—208.5 g theoretical MeOH)/2386 g=2.9% MeOH remaining in the reaction. After 180 minutes, the reaction is bottled and allowed to solidify at least overnight to yield the desired product.

In like fashion, methyl stearate, methyl palmitate and mixed palm and palm kernel oil fatty acid methyl esters are used to prepare the corresponding N-(3-methoxypropyl) glucamide surfactants for use herein.

Glyceride Process

If desired, the N-alkoxy and N-aryloxy surfactants used herein may be made directly from natural fats and oils rather than fatty acid methyl esters. This so-called "glyceride process" results in a product which is substantially free of conventional fatty acids such as lauric, myristic and the like, which are capable of precipitating as calcium soaps under wash conditions, thus resulting in unwanted residues on fabrics or filming/spotting in, for example, hard surface cleaners and dishware cleaners.

Triglyceride Reactant

The reactant used in the glyceride process can be any of the well-known fats and oils, such as those conventionally used as foodstuffs or as fatty acid sources. Non-limiting examples include: CRISCO oil; palm oil; palm kernel oil; corn oil; cottonseed oil; soybean oil; tallow; lard; canola oil; rapeseed oil; peanut oil; tung oil; olive oil; menhaden oil; coconut oil; castor oil; sunflower seed oil; and the corresponding "hardened", i.e., hydrogenated oils. If desired, low molecular weight or volatile materials can be removed from the oils by steam-stripping, vacuum stripping, treatment with carbon or "bleaching earths" (diatomaceous earth), or cold tempering to further minimize the presence of malodorous by-products in the surfactants prepared by the glyceride process.

N-substituted Polyhydroxy Amine Reactant

The N-alkyl, N-alkoxy or N-aryloxy polyhydroxy amines used in the process are commercially available, or can be prepared by reacting the corresponding N-substituted amine with a reducing sugar, typically in the presence of hydrogen and a nickel catalyst as disclosed in the art. Non-limiting examples of such materials include: N-(3-methoxypropyl) glucamine; N-(2-methoxyethyl) glucamine; and the like.

Catalyst

The preferred catalysts for use in the glyceride process are the alkali metal salts of polyhydroxy alcohols having at least two hydroxyl groups. The sodium (preferred), potassium or lithium salts may be used. The alkali metal salts of monohydric alcohols (e.g., sodium methoxide, sodium ethoxide, etc.) could be used, but are not preferred because of the formation of malodorous short-chain methyl esters, and the like. Rather, it has been found to be advantageous to use the alkali metal salts of polyhydroxy alcohols to avoid such problems. Typical, non-limiting examples of such catalysts include sodium glycolate, sodium glycerate and propylene glycolates such as sodium propyleneglycolate (both 1,3- and 1,2-glycolates can be used; the 1,2-isomer is preferred), and 2-methyl-1,3-propyleneglycolate. Sodium salts of NEODOL-type ethoxylated alcohols can also be used.

Reaction Medium

The glyceride process is preferably not conducted in the presence of a monohydric alcohol solvent such as methanol, because malodorous acid esters may form. However, it is preferred to conduct the reaction in the presence of a material such as an alkoxylated alcohol or alkoxylated alkyl phenol of the surfactant type which acts as a phase transfer agent to provide a substantially homogeneous reaction mixture of the polyhydroxy amine and oil (triglyceride) reactants. Typical examples of such materials include: NEODOL10-8, NEODOL 23-3, NEODOL 25-12 AND NEODOL 11-9. Pre-formed quantities of the N-alkoxy and N-aryloxy polyhydroxy fatty acid amides, themselves, can also be used for this purpose. In a typical mode, the reaction medium will comprise from about 10% to about 25% by weight of the total reactants.

Reaction Conditions

The glyceride process is preferably conducted in the melt. N-substituted polyhydroxy amine, the phase transfer agent (preferred NEODOL) and any desired glyceride oil are co-melted at 120° C.–140° C. under vacuum for about 30 minutes. The catalyst (preferably, sodium propylene glycolate) at about 5 mole % relative to the polyhydroxy amine is added to the reaction mixture. The reaction quickly becomes homogeneous. The reaction mixture is immediately cooled to about 85° C. At this point, the reaction is nearly complete. The reaction mixture is held under vacuum for an additional hour and is substantially complete at this point.

In an alternate mode, the NEODOL, oil, catalyst and polyhydroxy amine are mixed at room temperature. The mixture is heated to 85° C.–90° C., under vacuum. The reaction becomes clear (homogeneous) in about 75 minutes. The reaction mixture is maintained at about 90° C., under vacuum, for an additional two hours. At this point the reaction is complete.

In the glyceride process, the mole ratio of triglyceride oil:polyhydroxy amine is typically in the range of about 1:21 to 1:3.1.

Product Work-Up

The product of the glyceride process will contain the polyhydroxy fatty acid amide surfactant and glycerol. The glycerol may be removed by distillation, if desired. If desired, the water solubility of the solid polyhydroxy fatty acid amide surfactants can be enhanced by quick cooling from a melt, as noted above.

Apart from the foregoing surfactants, the present invention employs ingredients which are generally known in the art, but which are combined in a unique manner herein to provide important cleaning benefits in an automatic dishwashing detergent context. Nonlimiting examples of such ingredients are noted hereinafter for the convenience of the formulator.

Nonphosphorus Builder

The compositions herein may also contain a nonphosphorus detergency builder. It has been found that weak builders, especially organic carboxylate builders having a molecular weight below about 600, are especially useful to allow an effective composition which does not etch glass or chinaware. Normally, the formulators of detergent compositions attempt to employ high levels of the strongest possible builder in their formulations and indeed, when oxygen bleaches such as perborate, percarbonate or such bleaches with activators are used, stronger builders are needed for the most satisfactory stain removal results. However, in conjunction with the N-alkoxy or N-aryloxy polyhydroxy fatty acid amides used herein, the balance of the compositions herein provides adequate cleaning benefits even when weak builders are used, and this permits a substantial safety advantage with regard to the protection of the glaze on fine china and the strength and clarity of glassware. Citrate builders, particularly sodium citrate, are preferred for use herein. Glucoheptonate builders known in the art are likewise useful. Other useful carboxylate builders include the tartrate succinates, carboxymethyloxysuccinate, and the like, preferably in the form of water-soluble alkali metal salts.

Phosphorus Builder

If desired, and depending on local legislation, the compositions herein may be formulated with any of the conventional phosphate builders. Sodium tripolyphosphate (STPP) is typical. Various soluble ortho- or meta phosphates may also be used.

Bleach

The compositions herein will preferably contain a bleach which provides an additional cleaning function, especially for protein-based soils. Chlorine bleaches such as the chlorinated phosphates, chlorinated cyanurates, and the like, can be used. However, preferred compositions will comprise a nonchlorine bleach, such as a peracid or, more preferably, a persalt such as perborate (mono- or tetrahydrates), percarbonate, and the like. Combinations of such persalt bleaches with bleach activators such as tetraacetylethylenediamine (TAED) or nonanoyloxybenzene sulfonate (NOBS) can also be used. Monopersulfate salts (MPS bleach) is another type of nonchlorine bleach which optionally can be employed herein. A long-known and readily commercially available monopersulfate salt employed herein is a "triple salt". Commmercial compositions comprising this salt are available under the tradename OXONE, from DuPont.

Detersive Enzyme

The enzymes employed in the present compositions are of types well-known in the art. Such enzymes are commonly available in "prill" form. A prill is a fabricated particle containing varying proportions of active enzyme, inactive enzyme, and supporting materials which serve to stabilize the active enzyme during storage. For this reason, the levels of enzyme in the instant compositions are specified on the basis of active enzyme content. Assays may be carded out using any of the standard methods available from the enzyme suppliers. It is essentially immaterial to know the precise nature and level of the inactive components of the prill, except that it has been discovered that overly high levels of inactive enzyme and prill ingredients, e.g., above about 8% by weight of the fully-formulated ADD composition, actually tend to have adverse effects on the filming characteristics of the ADD; such levels should preferably be avoided.

Suitable enzymes herein comprise proteolytic enzymes well-known in the art. Proteolytic enzymes such as SAVINASE, ESPERASE and ALCALASE, sold by NOVO Industries, Copenhagen, Denmark, are particularly useful herein, since proteolytic enzymes serve to attack, degrade and remove various protein residues from the tableware being cleaned. Moreover, it has been discovered that in combination with oxygen bleach, such proteolytic enzymes, or their variants engineered for greater oxygen bleach stability, work exceptionally well for the removal of tea-with-milk stains from cups and mugs.

An especially preferred lipase enzyme is manufactured and sold by Novo Industries A/S (Denmark) under the tradename LIPOLASE (Biotechnology Newswatch, 7 Mar. 1988, page 6) and mentioned along with other suitable lipases in EP-A-0258068 (Novo). Another especially preferred lipase is described in EP-A-0218272 in the name of Gist-Brocades NV. Lipase enzyme may be incorporated into the compositions in accordance with the invention at a level of from 0.005% to 2% active enzyme by weight of the composition.

Amylase enzymes can also be used, either in combination with proteases in an optional, but preferred mode, or singly, in the compositions of the invention. Amylase sold by NOVO under the name TERMAMYL is a typical example.

Enzyme activity and enzyme activity measurement are described in detail in the following publications, incorporated herein by reference: "Enzyme Nomenclature Recommendations (1972) of the International Union of Pure and Applied Chemistry and the International Union of Biochemistry", 2nd Reprint, 1975, ISBN 0-444-41139-9 and Publications B259c (Alcalase), B260c (Esperase) and B274c (Termamyl), all published March 1988 by Novo Industfi A/S, Novo Alle', 2880 Bagsvaerd, Denmark.

Enzyme Stabilizing System

Preferred enzyme-containing compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

The stabilizing system of the ADDs herein may further comprise from 0 to about 10%; preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are widely available, indeed ubiquitous, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, titrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in the solid-form ADD composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Biginski et al.

Low-Sudsing Surfactant

The compositions herein may contain from 0% to about 10%, preferably from about 1% to about 7% by weight of a surfactant, preferably a low sudsing surfactant of the type typically used in conventional ADD compositions known in commerce. Such surfactants not only provide some cleaning action in the compositions, but also provide a "sheeting" action which causes water to drain from china and glassware, thereby reducing the tendency to form unsightly spots during drying in the automatic dishwashing machine. Typically, such low sudsing surfactants fall within the class known as nonionics, i.e., low sudsing nonionic (LSND surfactants, especially the so-called "block" polyoxyethylene-polyoxypropylene nonionics, but various other low-sudsing surfactants such as the long-chain phosphates and phosphate esters can also be used. The following is intended to further assist the formulator in the selection of surfactants for use herein, but is not by way of limitation.

The surfactant can be, for example, an ethoxylated surfactant derived from the reaction of a monohydroxy alcohol or alkylphenol containing from about 8 to about 20 carbon atoms, excluding cyclic carbon atoms if such are present, with from about 4 to about 15 moles of ethylene oxide per mole of alcohol or alkyl phenol on an average basis. A particularly preferred ethoxylated nonionic surfactant is derived from a straight chain fatty alcohol containing from about 16 to about 20 carbon atoms (C6–C20) alcohol), preferably a C18 alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average. The ethoxylated nonionic surfactant can also optionally contain propylene oxide in an amount up to about 15% by weight of the surfactant.

Another type of nonionic surfactant contains the ethoxylated monohydroxyaleohol or alkyl phenol and additionally comprises a polyoxyethylene-polyoxypropylene block polymeric compound; the ethoxylated monohydroxy alcohol or alkyl phenol nonionic surfactant comprising from about 20% to about 80%, preferably from about 30% to about 70%, of the total surfactant composition by weight.

Suitable block polyoxyethylene-polyoxypropylene polymeric compounds include those based on ethylene glycol, propylene glycol, glycerol, trimethylolpropane and ethylenediamine as an initiator reactive hydrogen compound. Polymeric compounds made from a sequential ethoxylation and propoxylation of initiator compounds with a single reactive hydrogen atom, such as C12–C28 aliphatic alcohols, do not usually provide satisfactory suds control. Certain of the block polymer surfactant compounds designated PLURONIC, PLURAFAC and TETRONIC by the BASF-Wyandotte Corp., Wyandotte, Mich. are suitable as the surfactant for use herein. A particularly preferred embodiment contains from about 40% to about 70% of a polyoxypropylene, polyoxyethylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene, initiated with tri-methylol propane, containing 99 moles of propylene oxide and 24 moles of ethylene oxide per mole of trimethylol propane.

Additional surfactants useful herein include relatively low-molecular weight nonionic types having melting-points at or above ambient temperatures, such as octyldimethylamine N-oxide dihydrate, decyldimethylamine N-oxide dihydrate, C8–C12 N-methylglucamides and the like. Such surfactants may advantageously be blended in the instant compositions with short-chain anionic surfactants, such as sodium octyl sulfate and similar alkyl sulfates, though short-chain sulfonates such as sodium cumene sulfonate could also be used. Short-chain nonionic types which tend to be liquid or melt close to ambient temperatures may be incorporated into the instant compositions by wicking them into an inorganic support, such as preformed granule comprising porous carbonate particles. Thus nonionics derived from monohydric alkanols with ethylene oxide, such as C10E3 through C10E8, where "E" refers to ethylene oxide, may be used in the instant compositions.

When sudsing tendencies of the compositions in-use are adversely affected by the use of surfactants with foaming tendencies, limited amounts of conventional suds suppressors such as silicone/silica mixtures, may be incorporated into the surfactant system of the instant compositions as taught in the literature.

Anionic Surfactant

The anionic surfactant may be essentially any anionic surfactant, including anionic sulfate, and sulfonate surfactant.

Highly preferred anionic surfactants herein are sodium or potassium salt-forms for which the corresponding calcium salt form has a low Kraft temperature of, for example, 30° C. or below, or, even better, 20° C. or lower. Without being limited by theory, including anionic surfactants, the calcium salts of which have low Kraft temperatures, into the surfactant systems in accord with the present invention tends to minimize film formation on hard surfaces. Examples of such highly preferred anionic surfactants are the alkyl (polyethoxy)sulfates.

Anionic Sulfate Surfactant

The anionic sulfate surfactant may be any organic sulfate surfactant. It is preferably selected from the group consisting of $C_6$–$C_{20}$ linear or branched chain alkyl sulfate which has been ethoxylated with from about 0.5 to about 20 moles of ethylene oxide per molecule, $C_9$–$C_{17}$ acyl-N-($C_1$–$C_4$ alkyl) glucamine sulfated, —N—($C_2$–$C_4$ hydroxyalkyl) glucamine sulfate, and mixtures thereof. More preferably, the anionic sulfate surfactant is a $C_6$–$C_{18}$ alkyl sulfate which has been ethoxylated with from about 0.5 to about 20, preferably from about 0.5 to about 5, moles of ethylene oxide per molecule.

Preferred alkyl ethoxy sulfate surfactants comprise a primary alkyl ethoxy sulfate derived from the condensation product of a $C_6$–$C_{18}$ alcohol with an average of from about 0.5 to about 20, preferably from about 0.5 to about 5, ethylene oxide groups. The $C_6$–$C_{18}$ alcohol itself is preferable commercially available. $C_{12}$–$C_{15}$ alkyl sulfate which has been ethoxylated with from about 1 to about 5 moles of ethylene oxide per molecule is preferred alkyl ethoxy sulfate surfactant. Highly branched $C_{10}$–$C_{18}$ alkyl ethoxy sulfates, with a degree of ethoxylation of from 5 to 20, in combination with linear methyl branched $C_6$–$C_{10}$ alkyl ethoxy sulfates with a degree of ethoxylation of from 5 to 20 are also preferred.

Where the compositions of the invention are formulated to have a pH of between 6 to 9.5, preferably between 7.5 to 9, wherein the pH is defined herein to be the pH of a 1% solution of the composition measured at 20° C., surprisingly robust soil removal, particularly proteolytic soil removal, is obtained when $C_{10}$–$C_{18}$ alkyl ethoxysulfate surfactant, with an average degree of ethoxylation of from 0.5 to 5 is incorporated into the composition in combination with a proteolytic enzyme, such as neutral or alkaline proteases at a level of active enzyme of from 0.005% to 2%. Preferred alkyl ethoxysulfate surfactant for inclusion in such compositions with a pH of between 6 to 9.5 are the $C_{12}$–$C_{15}$ alkyl ethoxysulfate surfactants with an average degree of ethoxylation of from 1 to 5, preferably 2 to 4, most preferably 3.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Anionic sulfate surfactants include the $C_5$–$C_{17}$ acyl-N-($C_1$–$C_4$ alkyl) and —N—($C_1$–$C_2$ hydroxyalkyl).glucamine sulfates, preferably those in which the $C_5$–$C_{17}$ acyl group is derived from coconut or palm kernel oil. These materials can be prepared by the method disclosed in U.S. Pat. No. 2,717,894, Schwartz, issued Sep. 13, 1955.

The counterion for the anionic sulfate surfactant component is preferably selected from calcium, sodium, potassium, magnesium, ammonium, or alkanolammonium, and mixtures thereof, more preferably sodium or potassium, or mixtures thereof.

Anionic Sulfonate Surfactant

Anionic sulfonate surfactants suitable for use herein include essentially any sulfonate surfactants including, for example, the salts (e.g., alkali metal salts) of $C_5$–$C_{20}$ linear alkylbenzene sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, paraffin sulfonates, and any mixtures thereof. Certain sulfonate surfactants may form precipitates with hardness ions making them less preferred for use herein.

Anionic Alkyl Ethoxy Carboxylate Surfactant

Alkyl ethoxy carboxylates suitable for use herein include those with the formula $RO(CH_2CH_2O)_xCH_2COO^-M^+$ wherein K is a $C_6$ to $C_{18}$ alkyl group, x ranges from 0 to 10, and the ethoxylate distribution is such that, on a weight basis, the amount of material where x is 0 is less than about 20%, preferably less than about 15%, most preferably less than about 10%, and the amount of material where x is greater than 7, is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation, preferably chosen from alkali metal, alkaline earth metal, ammonium, mono-, di-, and tri-ethanol-ammonium, most preferably from sodium, potassium, ammonium and mixtures thereof with magnesium ions. The preferred alkyl ethoxy carboxylates are those where R is a $C_{12}$ to $C_{18}$ alkyl group.

Anionic Alkyl Polyethoxy Polycarboxylate Surfactant

Alkyl polyethoxy polcarboxylate surfactants suitable for use herein include those having the formula:

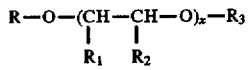

wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Alkali Metal Sarcosinate Surfactant

Other anionic surfactants suitable for the purposes of the invention are the alkali metal sarcosinates of formula R—CON ($R^1$) $CH_2COOM$ wherein R is a $C_5$–$C_{17}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Alkyl Ester Sulphonate Surfactants

Another class of anionic surfactants useful herein are the alkyl ester sulfonate surfactants which include linear esters of $C_8$–$C_{20}$ carboxylic acids (i.e., fatty acids) which are sulfonated with gaseous $SO_3$ according to "The Journal of the American Oil Chemists Society," 52 (1975), pp. 323–329. Suitable starting materials would include natural fatty substances as derived from tallow, palm oil, etc.

The preferred alkyl ester sulfonate surfactants have the structural formula:

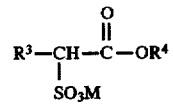

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{18}$ alkyl, and $R^4$ is methyl, ethyl or isopropyl. Especially preferred are the methyl ester sulfonates wherein $R^3$ is $C_{10}$–$C_{18}$alkyl.

Other Anionic Surfactants

Other anionic surfactants useful for detersive purposes can also be included in the compositions hereof. These can include salts (including, for example, sodium, potassium, ammonium, and substituted ammonium salts such as mono-, di- and triethanolamine salts) of fatty oleyl glycerol sulfates, alkyl phenol ethylene oxide ether sulfates, alkyl phosphates, isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described herein), branched primary alkyl sulfates, alkyl polyethoxy carboxylates such as those of the formula $RO(CH_2CH_{20})_kCH_2COO^-M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al at Column 23, line 58 through Column 29, line 23.

Amine Oxide Surfactant

The ADD compositions of the present invention optionally, but preferably, comprise an amine oxide surfactant in accordance with the general formula I:

$$R^1(EO)_x(PO)_y(BO)_zN(O)(CH_2R')_{2-q}H_2O \quad (I)$$

In general, it can be seen that the structure (I) provides one long-chain moiety $R^1(EO)_x(PO)_y(BO)_z$ and two short-chain moieties, $CH_2R'$. R' is preferably selected from methyl and —$CH_2OH$. In general $R^1$ is a primary or branched hydrocarbyl moiety which can be saturated or unsaturated, preferably, $R^1$ is a primary alkyl moiety. When x+y+z=0, $R^1$ is a hydrocarbyl moiety having chainlength of from about 16 to about 18. When x+y+z is different from 0, $R^1$ may be somewhat shorter or longer, having a chainlength in the range $C_{12}$–$C_{24}$. The general formula also encompasses amine oxides wherein x+y+z=0, $R^1$=$C_{16}$–$C_{18}$, R'=H and z=0–2, preferably 2. These amine oxides are illustrated by hexadecyl dimethylamine oxide, octadecylamine oxide and their hydrates, especially the dihydrates as disclosed in U.S. Pat. Nos. 5,075,501 and 5,071,594, incorporated herein by reference.

The compositions may also employ amine oxides wherein x+y+z is different from zero, specifically x+y+z is from about 1 to about 10, $R^1$ is a primary alkyl group containing 12 to about 24 carbons, preferably from about 12 to about 16 carbon atoms; in these embodiments y+z is preferably 0 and x is preferably from about 1 to about 6, more preferably from about 2 to about 4; EO represents ethyleneoxy; PO represents propyleneoxy; and BO represents butyleneoxy. Such amine oxides can be prepared by conventional synthetic methods, e.g., by the reaction of alkylethoxysulfates with dimethylamine followed by oxidation of the ethoxylated amine with hydrogen peroxide.

Highly preferred amine oxides herein are solids at ambient temperature, more preferably they have melting-points in the range 30° C. to 90° C. Amine oxides suitable for use herein are made commercially by a number of suppliers, including Akzo Chemie, Ethyl Corp., and Procter & Gamble. See McCutcheon's compilation and Kirk-Othmer review article for alternate amine oxide manufacturers. Preferred commercially available amine oxides are the solid, dihydrate ADMOX 16 and ADMOX 18 from Ethyl Corp.

Preferred embodiments include hexadecyldimethylamine oxide dihydrate, octadecyldimethylamine oxide dihydrate and hexadecyltris(ethyleneoxy)dimethylamine oxide.

Whereas in certain of the preferred embodiments $R'=CH_3$, there is some latitude with respect to having R' slightly large than H. Specifically, the invention further encompasses embodiments wherein $R'=CH_2OH$, such as hexadecylbis(2-hydroxyethyl)amine oxide, tallowbis(2-hydroxyethyl)amine oxide, stearylbis(2-hydroxyethylamine oxide and oleylbis(2-hydroxyethyl)amine oxide.

As noted, certain preferred embodiments of the instant ADD compositions comprise amine oxide dihydrates. Conventional processes can be used to control the water content and crystallize the amine oxide in solid dihydrate form. A new process comprises (a) conventionally making amine oxide as an aqueous solution or aqueous/organic solvent solution by reacting appropriate parent amine and aqueous hydrogen peroxide (for example, 50% $H_2O_2$); (b) drying the product to secure substantially anhydrous amine oxide (with or without an organic solvent being present to keep the viscosity low); (c) adding two mole equivalents of water per mole of amine oxide; and (d) recrystallizing the wet amine oxide from a suitable solvent, such as ethyl acetate.

In formulating the instant ADD compositions, the amine oxide may be added to an ADD composition as a powder. This is especially appropriate in the case of the amine oxide dihydrates, since these are nonhygroscopic solids. When it is desired to use the anhydrous form of the amine oxides, it is preferable to protect the amine oxide from moisture. It is contemplated to achieve this by conventional means, such as by applying a relatively nonhygroscopic coating, e.g., an anhydrous coating polymer, to amine oxide particles. Alternatively, and more preferably, the anhydrous amine oxide should be melted with a conventional low-melting, waxy nonionic surfactant which is other than an amine oxide material. Such LSNI surfactants are disclosed hereinabove. A desirable process comprises heating the LSNI to just above its melting-point, then adding the amine oxide steadily to the heated LSNI, optionally (but preferably) stirring to achieve a homogeneous mixture; then, optionally (but preferably) chilling the mixture. When the LSNI has a lower melting point than the amine oxide, the amine oxide need not be completely melted at any stage. The above process illustrates a manner in which the time and extent of exposure of amine oxide to heat are minimized both by selecting the order of addition and which component (LSNI) to heat first. Once co-melted and cooled into a suitable LSNI, the combined LSNI/amine oxide may be applied to an inorganic support, e.g., a pH-adjusting component described hereinafter). One suitable approach is to form an agglomerate comprising amine oxide, LSNI and water-soluble alkaline inorganic salt or water-soluble organic or inorganic builder. In another embodiment, the amine oxide in anhydrous form is melted with a solid-form alcohol or, preferably, an ethoxylated alcohol: this may be appropriate if more cleaning action is required and less sheeting action is desired (e.g., in geographies wherein rinse-aid use is common).

The present invention can contain from about 0.1% to about 10%, preferably from about 1% to about 7%, more preferably from about 1.5% to about 5% of the long chain amine oxide; levels are generally expressed on an anhydrous basis unless otherwise specifically indicated.

Solubilizing Aids for Long-Chain Amine Oxide

Although short-chain amine oxides do not alone provide the cleaning effect of the essential long-chain amine oxide component of the invention, it has been discovered that adding short-chain amine oxides, such as octyldimethylamine oxide, decyldimethylamine oxide, dodecylamine oxide and tetradecylamine oxide as solubilizing aids to the long-chain amine oxide can be desirable. This is especially preferred if the composition is for use in cold-fill automatic dishwashing appliances. When present, a short-chain amine oxide solubilizer is preferably at not more than 1/10 of the total mass of the cleaning amine oxide component. Thus, levels of short-chain amine oxide are typically in the range from about 0 to about 2.0%, preferably about 0.1% to about 1% of the ADD composition. Moreover, it has been discovered that a short-chain amine oxide, if used, is preferably uniformly dispersed within the long-chain amine oxide rather than being added to the ADD in a separate particle.

In addition to the solubilizing effect, it is surprisingly discovered that the combination of long- and short-chain amine oxide is very effective for cleaning purposes.

When the granular automatic dishwashing compositions are destined for use in hot-fill automatic dishwashing appliances, e.g., those commonly available in the United States, the essential long-chain amine oxide preferably comprises $R^1=C_{18}$ and is preferred over $R^1=C_{16}$ on grounds of mass efficiency; in this circumstance the use of short-chain amine oxide solubilizers is typically avoided.

Non-amine oxide solubilizing aids can be substituted, for example, solid-form alcohols or alcohol ethoxylates (the same as may be independently used for sheeting action or protection of the long-chain amine oxide from water discussed hereinabove) can be used for this purpose.

Organic Dispersant

As noted hereinabove, the present compositions contain organic dispersant which overcomes the problem of unsightly films which form on china and especially on glassware due to calcium- or magnesium-hardness-induced precipitation of pH-adjusting agents, especially carbonates, used herein.

The organic dispersants herein are used at levels of at least about 0.1%, typically from about 1% to about 10%, most preferably from about 1% to about 7% of the automatic dishwashing composition. Such organic dispersants are preferably water-soluble sodium polycarboxylates. ("Polycarboxylate" dispersants herein generally contain truly polymeric numbers of carboxylate groups, e.g., 8 or more, as distinct from carboxylate builders, sometimes called "polycarboxylates" in the art when, in fact, they have relatively low numbers of carboxylate groups such as four per molecule.) The organic dispersants are known for their ability to disperse or suspend calcium and magnesium "hardness", e.g., carbonate salts. Crystal growth inhibition, e.g., of Ca/Mg carbonates, is another useful function of such materials. Preferably, such organic dispersants are polyacrylates or acrylate-containing copolymers. "Polymeric Dispersing Agents, SOKALAN", a printed publication of BASF Aktiengesellschaft, D-6700 Ludwigshaven, Germany, describes organic dispersants useful herein. Sodium polyacrylate having a nominal molecular weight of about 4500, obtainable from Rohm & Haas under the tradename as ACUSOL 445N, or acrylate/maleate copolymers such as are available under the tradename SOKALAN, from BASF Corp., are preferred dispersants herein. These polyanionic materials are, as noted, usually available as viscous aqueous solutions, often having dispersant concentrations of about 30–50%. The organic dispersant is most commonly fully neutralized; e.g., as the sodium salt form.

While the foregoing encompasses preferred organic dispersants for use herein, it will be appreciated that other oligomers and polymers of the general polycarboxylate type can be used, according to the desires of the formulator. Suitable polymers are generally at least partially neutralized in the form of their alkali metal, ammonium or other conventional cation salts. The alkali metal, especially sodium salts, are most preferred. While the molecular weight of such dispersants can vary over a wide range, it preferably is from about 1,000 to about 500,000, more preferably is from about 2,000 to about 250,000, and most preferably is from about 3,000 to about 100,000. Nonlimiting examples of such materials are as follows.

For example, other suitable organic dispersants include those disclosed in U.S. Pat. No. 3,308,067 issued Mar. 7, 1967, to Diehl, incorporated herein by reference. Unsaturated monomeric acids that can be polymerized to form suitable polymeric polycarboxylates include maleic acid (or maleic anhydride), fumaric acid, itaconic acid, aconitic acid, mesaconic acid, citraconic acid and methylenemalonic acid. The presence of monomeric segments containing no carboxylate radicals such as vinylmethyl ether, styrene, ethylene, etc. is suitable, preferably when such segments do not constitute more than about 40% by weight of the polymer.

Other suitable organic dispersants for use herein are copolymers of acrylamide and acrylate having a molecular weight of from about 3,000 to about 100,000, preferably from about 4,000 to about 20,000, and an acrylamide content of less than about 50%, preferably less than about 20%, by weight of the polymer. Most preferably, the polymer has a molecular weight of from about 4,000 to about 10,000 and an acrylamide content of from about 1% to about 15%, by weight of the polymer.

Still other useful organic dispersants include acrylate/maleate or acrylate/fumarate copolymers with an average molecular weight in acid form of from about 2,000 to about 80,000 and a ratio of acrylate to maleate or fumarate segments of from about 30:1 to about 2:1. Other such suitable copolymers based on a mixture of unsaturated mono- and dicarboxylate monomers are disclosed in European Patent Application No. 66,915, published Dec. 15, 1982, incorporated herein by reference. Yet other organic dispersants are useful herein, as illustrated by water-soluble oxidized carbohydrates, e.g., oxidized starches prepared by art-disclosed methods.

With regard to the formulations herein, it is preferred that the ratio of organic disperant to Available Oxygen from monopersulfate salts is in the range from about 0.5:1 to about 8:1, preferably from about 0.5:1, to about 5:1, by weight.

pH-Adjusting Agent

The compositions herein also contain at least one source of alkalinity so as to achieve an in-use pH above 7. It will be appreciated by those familiar with compositions for use in the home that accidental ingestion of high alkalinity products can pose safety concerns. Moreover, such concerns would be increased in the case of highly alkaline, low-dosage compositions. While the invention is effective at a pH in the highly alkaline range, it is an advantage herein not to be limited to compositions with such alkalinity levels.

Wash pH's suitable for effective stain removal in the practice of this invention are generally in the range from about 8 to about 11, more preferably from about to about 9.5 to about 10.5 when water-soluble silicates are present though the invention encompasses other preferred embodiments in which the pH range is from about 8 to about 9.5, from which water-soluble silicates are absent and wherein the pH-adjusting function is performed only by the carbonate ingredient which can take the form of sodium bicarbonate or a sodium carbonate/bicarbonate mixture. To be noted, the perborate-type bleach systems are ineffective at the most desirable low end of these ranges, especially in the low-dosed product form provided herein. The water-soluble carbonate salts, especially sodium carbonate and bicarbonate, are useful alkalinity sources herein, and when present are typically used at levels from about 5% to about 25%, preferably from about 8% to about 20% by weight of the final granular product. It will be appreciated by those familiar with ADD compositions that excessive amounts of carbonate can result in undesirable filming on cleansed tableware. However, the tendency to filming is offset by use of organic dispersant materials disclosed hereinabove.

Importantly, material care benefits are best imparted to the instant compositions either when they are formulated at the moderate pH's (8–9.5) without soluble silicates (in which case sodium bicarbonate, sodium carbonate or a mixture of the two will be used for the pH-adjusting function), or when they are formulated at the somewhat higher (9.5–10.5) pH range when a mixture of water-soluble silicate and sodium carbonate is typically used as pH-adjusting agent.

When the compositions herein contain water-soluble silicate as a component of the pH-adjusting agent, these silicates not only provide alkalinity to the compositions, but also provide anti-corrosion benefits for aluminum utensils and appear to contribute to glaze protection on chinaware.

Since the compositions herein are formulated to contain limited amounts of free water for best storage stability, but since on the other hand complete dehydration of silicates tends to limit water-solubility of the compositions, it is important that the water-soluble silicates processed into the formulations ultimately have solid hydrous form. This can be achieved either by admixing into the composition preformed solid hydrous silicates as the water-soluble silicate component, or by relying on a more inexpensive liquid silicate stock, which is dehydrated to a limited extent during granule-making.

When water-soluble silicates are used in the practice of the invention, their level in the fully-formulated composition in preferred embodiments is in the range from about 4% to about 25%, more preferably from about 6% to about 15%, dry basis, based on the weight of the automatic dishwashing detergent composition. The mole ratio of $SiO_2$ to the alkali metal oxide ($M_2O$, where M is alkali metal) is typically from about 1 to about 3.2, preferably from about 1.6 to about 3, more preferably from about 2 to about 2.4. Preferable $H_2O$ levels in commercial raw material forms of the water-soluble silicate component itself are from about 15% to about 25%, more preferably, from about 17% to about 20% of the water-soluble silicate component.

The highly alkaline metasilicates can be employed, although the less alkaline hydrous alkali metal silicates having a $SiO_2$:$M_2O$ ratio of from about 2.0 to about 2.4 are preferred.

Sodium and potassium, and especially sodium silicates are preferred. Particularly preferred alkali metal silicates are granular hydrous sodium silicates having $SiO_2$:$Na_2O$ ratios of from 2.0 to 2.4 available from PQ Corporation, named BRITESIL H-20 and BRITESIL H24. Most preferred is granular or powder-form hydrous sodium silicate having a $SiO_2$:$Na_2O$ ratio of about 2.0. Potassium analogs could be employed, but are generally more expensive.

While typical forms, i.e., powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

Chlorine Bleach Scavenger

As noted hereinabove, the preferred compositions herein contain detersive enzymes. It has been determined that chlorine bleach species present in many water supplies can attack and inactivate such enzymes, especially under alkaline conditions. While chlorine levels in water may be small, typically in the range from about 0.5 ppm to about 1.75 ppm Available Chlorine, the total volume of water that comes in contact with the enzyme during dishwashing is usually large; accordingly, enzyme stability in-use can be problematic. Unlike the more conventional Oxygen bleach perborate, the monopersulfate bleach herein is not of its own accord a chlorine bleach scavenger. However, it has now been determined that scavenger materials such as sodium perborate can be used in the compositions as a chlorine scavenger. Accordingly, preferred compositions herein will contain up to about 1.5%, preferably from about 0.1% to about 0.5%, by weight of a chlorine bleach scavenger, such as a water-soluble perborate salt. Either sodium perborate tetrahydrate or sodium perborate monohydrate can be used for this chlorine scavenging purpose. Alternatively, boron-free scavengers may be used, in which case somewhat larger quantities may be useful. Preferred boron-free scavengers include percarbonate salts, malate salts, tartrate, ammonium sulfate and lower alkanolamines.

Bleach Stabilizer

The compositions herein will preferably also contain a bleach stabilizer whose primary purpose is to sequester transition metal ions that can decompose monopersulfate bleach. Such bleach stabilizers generally are selected from organic nitrogen-containing sequestrants and organic phosphorus-containing sequestrants and are thus distinguished from the weak builders herein which do not contain nitrogen or phosphorus. Conveniently, bleach stabilizers can be blended with commercial monopersulfate in granular form, e.g., in OXONE granules. It may also be advantageous to have low levels of bleach stabilizer dispersed throughout the composition. In this mode, it is believed that the bleach stabilizer is principally active as a storage-stabilizer for the bleach. Otherwise, bleach stabilizers such as the common chelant diethylenetdaminepentaacetate can be added to the compositions to provide the desired stabilizing function.

In more detail, the bleach stabilizer in the fully-formulated granular automatic dishwashing detergent compositions herein can be used at levels ranging from the minimum amount required for bleach stabilizing purposes (e.g., as low as about 0.05% to 0.1%) to much higher levels (e.g., about 0.5% or higher) which are very useful levels not only for best achieving the instant process, but also for achieving enhanced functionality of the automatic dishwashing detergent (e.g., food/beverage stain removal from dishes, transition metal oxide film control or removal, and the like.) When bleach stabilizer is present, more typical levels are thus from about 0.05% to about 2% or higher, preferably from about 0.1% to about 0.7%, all percentages on a weight basis of the final automatic dishwashing composition.

Bleach stabilizers suitable for use herein of the organic nitrogen-containing type are further illustrated by the sodium and potassium salts of ethylenediaminetetraacetic acid (EDTA), diethylenetriamine pentaacetic acid (DTPA), hydroxyethylenediamine triacetic acid (HEDTA), triethylenetetramine hexaacetic acid (TTHA), nitrilotriacetic acid (NTA), N,N'-(1-oxo-1,2,-ethanediyl)-bis(aspartic acid) (OEDBA), and ethylenediamine disuccinic acid (EDDS); see U.S. Pat. No. 4,704,233.

Bleach stabilizers of the organic phosphorus containing type are further illustrated by ethylenediaminetetra-(methylenephosphonic acid), diethylenetriaminepenta (methylene phosphonic acid) and hydroxy-ethylidine-diphosphonic acid (EHDP). Certain of these materials have been found to behave somehat unpredictably, it is believed due to variations in quality of raw material. Therefore, such organic phosphorus-containing sequestrants are not as highly preferred as the nitrogen types for use in the present invention.

Highly preferred bleach stabilizers are the nonphosphorus chelants, such as EDDS and OEDBA. These are believed to have attractive characteristics from the viewpoint of the environment; for example, EDDS has two chiral centers and not only synthetic or mixed isomers, but also the natural isomers such as the [S,S] isomer can be used compatibly with this invention.

Of the foregoing bleach stabilizers, all but OEDBA derivatives are well-known in the art. OEDBA is disclosed by Glogowski et al in U.S. Pat. No. 4,983,315, issued Jan. 8, 1991, incorporated herein by reference.

A document generally useful in the context of this invention for its disclosure of commercial chemicals, including but not limited to chelants, their trademark names and commercial sources of supply, is "Chem Cyclopedia 91, The Manual of Commercially Available Chemicals", a publication of the American Chemical Society, 1990, ISBN 08412-1877-3, incorporated herein by reference.

Although, the sodium and potassium, i.e., alkali metal salts of the bleach stabilizers are preferred, they can, in general, be in the acid form or can be partly or fully neutralized, e.g., as the sodium salt.

Suds Suppressors

An important component of the granular detergent compositions of the invention is a suds suppressing system present at a level of from 0.05% to 20%, preferably from 1% to 10%, most preferably from 2% to 8% by weight of the composition. The suds suppressing system can comprise various well-known silicone suppressors, phosphated alcohols, acids, and the like. One preferred suds suppressor comprises, in combination, a spray-on component and a particulate component.

The spray-on component of the suds suppressing system is characterized by its fluid nature and by its method of incorporation into the granular detergent composition, namely by a spraying on process.

The spray-on component comprises in combination an antifoam compound and a carrier fluid and optionally a dispersant compound. The antifoam compound is dissolved, dispersed, suspended or emulsified in said carrier fluid. The carrier fluid should be inert in nature, that is it should not undergo undesirable chemical reaction with the antifoam compound, and also preferably be storage stable under normal atmospheric conditions and in the environment of a granular detergent matrix.

The spray-on component is incorporated into the granular detergent compositions of the invention by a spray-on process, that is a process whereby the liquid is sprayed on to some or all of the individual granular components of the composition. Highly preferably the spray-on process will be such as to provide a uniform and sufficient application of the suds suppressing component to any granular components of the composition which comprise a high sudsing surfactant.

A preferred composition for the spray-on component comprises:

(a) antifoam compound, preferably silicone antifoam compound, most preferably a silicone antifoam compound comprising in combination
  i) polydimethyl siloxane, at a level of from about 50% to about 99%, preferably about 75% to about 95% by weight of the silicone antifoam compound; and
  ii) silica, at a level of from about 1% to about 50%, preferably about 5% to about 25% by weight of the silicone/silica antifoam compound; wherein said silica/silicone antifoam compound is incorporated at a level of from about 5% to about 50%, preferably about 10% to about 40% by weight of the spray-on compound;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from about 0.5% to about 10%, preferably from about 1% to about 10% by weight of the spray-on component; a particularly preferred silicone glycol rake copolymer of this type is DCO544, commercially available from Dow Corning;

(c) an inert carrier fluid compound, most preferably comprising a $C_{16}$–$C_{18}$ ethoxylated alcohol with a degree of ethoxylation of from about 5 to about 50, preferably from about 8 to about 15, at a level of from about 5% to about 80%, preferably from about 10% to about 70%, by weight of the spray-on component.

The spray-on component of the suds suppressing system may be incorporated as such, or in a preferred execution may be mixed with other components such as liquid nonionic surfactants, and perfume, and this mixture sprayed on as a whole.

The particulate component of the suds suppressing system is characterized by its particulate form and by its incorporation into the compositions of the invention in this form.

By particulate form it is meant essentially any of the particulate forms which may be typically adapted by a component of a granular detergent composition. The particulate component can therefore be, for example, in the form of granules, flakes, prills, marumes or noodles. In a preferred execution the particulate is granular in nature. Granules themselves may be agglomerates formed by pan or drum agglomeration or by an in-line mixer, and also may be spray-dried particles produced by atomizing an aqueous slurry of the ingredients in a hot air stream which removes most of the water. The spray dried granules are then subjected to densification steps, e.g., by high speed cutter mixers and/or compacting mills, to increase density before being reagglomerated.

The particulate component of the suds suppressing system comprises in combination antifoam compound, and a carrier material which is highly preferably water-soluble or water-dispersible in nature.

A suitable particulate antifoam component useful in the compositions herein comprises a mixture of an alkylated siloxane of the type hereinabove disclosed and solid silica.

The solid silica can be a fumed silica, a precipitated silica or a silica, made by the gel formation technique. The silica particles suitable have an average particle size of from about 0.1 to about 50 micrometers, preferably from about 1 to about 20 micrometers and a surface area of at least $50m^2/g$. These silica particles can be rendered hydrophobic by treating them with dialkylsilyl groups and/or trialkylsilyl groups either bonded directly onto the silica or by means of a silicone resin. It is preferred to employ a silica the particles of which have been rendered hydrophobic with dimethyl and/or trimethyl silyl groups. A preferred particulate antifoam compound for inclusion in the detergent compositions in accordance with the invention suitably contains an amount of silica such that the weight ratio of silica to silicone lies in the range from about 1:100 to about 3:10, preferably from about 1:50 to about 1:7.

Another suitable particulate antifoam component is represented by a hydrophobic silanated (most preferably trimethyl-silanated) silica having a particle size in the range from about 10 nanometers to about 20 nanometers and a specific surface area above $50m^2/g$, intimately admixed with demethyl silicone fluid having a molecular weight in the range from about 500 to about 200,000 at a weight ratio of silicone to silanated silica of from about 1:1 to about 1:2.

Suitable particulate antifoam components are disclosed in Bartollota et al U.S. Pat. No. 3,933,672.

A highly preferred particulate antifoam component is described in EP-A-0210731 and comprises a silicone antifoam compound and an organic carrier material having a melting point in the range 50° C. to 85° C., wherein the organic earlier material comprises a monoester of glycerol and a fatty acid having a carbon chain containing from 12 to 20 carbon atoms. EP-A-0210721 discloses other preferred particulate antifoam components wherein the organic carrier material is a fatty acid or alcohol having a carbon chain containing from 12 to 20 carbon atoms, or a mixture thereof, with a melting point of from 45° C. to 80° C.

Other highly preferred particulate antifoam components are described in copending European Application 91870007.1 in the name of The Procter & Gamble Company which components comprise silicone antifoam compound, a carrier material, an organic coating material and glycerol at a weight ratio of glycerol:silicone antifoam compound of 1:2 to 3:1. Copending European Application 91201342.0 also discloses highly preferred particulate antifoam components comprising silicone antifoam compound, a carrier material, an organic coating material and crystalline or amorphous aluminosilicate at a weight ratio of aluminosilicate:silicone antifoam compound of 1:3 to 3:1. The preferred carrier material in both of the above-described highly preferred granular suds controlling agents is starch.

An exemplary particulate antifoam component for use herein is a particulate agglomerate component, made by an agglomeration process, comprising in combination:

i) from about 5% to about 30%, preferably from about 8% to about 15% by weight of the component of silicone antifoam compound, preferably comprising in combination polydimethyl siloxane and silica;

ii) from about 50% to about 90%, preferably from about 60% to about 80% by weight of the component, of carrier material, preferably starch;

iii) from about 5% to about 30%, preferably from about 10% to about 20% by weight of the component of agglomerate binder compound, where herein such compound can be any compound, or mixtures thereof typically employed as binders for agglomerates, most preferably said agglomerate binder compound comprises a $C_{16}$–$C_{18}$ ethoxylated alcohol with a degree of ethoxylation of from about 50 to about 100; and iv) from about 2% to about 15%, preferably from about 3% to about 10%, by weight of $C_{12}$–$C_{22}$ hydrogenated fatty acid.

The incorporation of silicone antifoam compounds as components of separate particulate components also permits the inclusion therein of $C_{20}$–$C_{24}$ fatty acids, microcrystalline waxes and high molecular weight copolymers of ethylene oxide and propylene oxide which would otherwise adversely affect the dispersibility of the matrix. Techniques for forming such particulates are disclosed in U.S. Pat. No. 3,933, 672.

A preferred suds suppressing system in accord with the invention has the weight ratio of antifoam compound comprised in the spray-on component to antifoam compound comprised in the particulate component of from about 5:1 to about 1:1, most preferably from about 4:1 to about 2:1.

An antifoam compound is a required element of both the spray on and particulate components of the suds suppressing system. By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types.

Preferred silicone antifoam compounds are the siloxanes having the general structure:

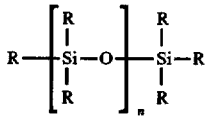

wherein each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end-blocking units and having a viscosity at 25° C. of from 5×10–5m2/s to 0.1M2/s, i.e., a value on n in the range 40 to 1500. These are preferred because of their ready availability and their relatively low cost.

Other suitable antifoam compounds include the monocarboxylic fatty acids and soluble salts thereof. These materials are described in U.S. Pat. No. 2,954,347, issued Sep. 27, 1960 to Wayne St. John the monocarboxylic fatty acids, and salts thereof, for use as suds suppressor typically have hydrocarbyl chains of from about 10 to about 24 carbon atoms, preferably from about 12 to about 18 carbon atoms. Suitable salts include the alkali metal salts such as sodium, potassium, and lithium salts, and ammonium and alkanolammonium salts. Other suitable antifoam compounds include, for example, high molecular weight hydrocarbons such as paraffin, fatty esters (e.g., fatty acid triglycerides), fatty acid esters of monovalent alcohols, aliphatic $C_{18}$–$C_{40}$ ketones (e.g., stearone), N-alkylated amino triazines such as tri- to hexa- alkylmelamines or di- to tetra- alkyldiamine chlortriazines formed as products of cyanuric chloride with two or three moles of a primary or secondary amine coming 1 to 24 carbon atoms, propylene oxide, and monostearyl di-alkali metal (e.g., sodium, potassium, lithium) phosphates and phosphate esters. The hydrocarbons, such as paraffin and haloparaffin, can be utilized in liquid form. The liquid hydrocarbons will be liquid at room temperature and atmospheric pressure, and will have a pour point in the range of about –40° C. and about 5° C., and a minimum boiling point not less than 110° C. (atmospheric pressure). It is also known to utilize waxy hydrocarbons, preferably having a melting point below about 100° C. Hydrocarbon suds suppressors are described, for example, in U.S. Pat. No. 4,265, 779, issued May 5, 1981 to Gandolfo et at. The hydrocarbons, thus, include aliphatic, alicyclic, aromatic, and heterocyclic saturated or unsaturated hydrocarbons having from about 12 to about 70 carbon atoms. The term "paraffin", as used in this suds suppressor discussion, is intended to include mixtures of true paraffins and cyclic hydrocarbons.

Copolymers of ethylene oxide and propylene oxide, particularly the mixed ethoxylated/propoxylated fatty alcohols with an alkyl chain length of from 10 to 16 carbon atoms, a degree of ethoxylation of from 3 to 30 and a degree of propoxylation of from 1 to 10, are also suitable antifoam compounds for use herein.

Water Content

The water content of the granular compositions herein should preferably be kept to a level below about 6% by weight of free moisture. This is due in part to the desirability of having free-flowing granules, and in part due to the need to keep bleach ingredients optimally stable on storage.

Cleaning Method

The method herein for cleaning tableware, and the like, comprises, in an automatic dishwashing appliance containing tableware, such as flatware, cups and mugs, glassware, dinner plates and/or pots and pans, the step of washing said tableware by contact with an aqueous bath typically comprising from about 1000 ppm to about 4000 ppm, more preferably from about 2000 ppm to about 3000 ppm, of the instant compositions. Preferably the appliance is a commercial domestic automatic dishwasher and there will be two such steps in sequence, with one or more rinse steps, in which no composition is dispensed, intervening between the said washing steps. Temperatures in the method can vary quite widely, but in accordance with normal practice, hot water preheated outside the appliance and having a temperature in the range from about 100° F. (37.8° C.) to about 150° F. (65.6° C.) may be used. Alternatively, and depending on the power output of the heating coil which may be present in the appliance, cold water fill, such as at a temperature of from about 40° F. (4.4° C.) to about 80° F. (26.7° C.), can be used and the water is heated in the appliance to temperatures of about 150° F. (65.6° C.), or higher. In a preferred embodiment of the method, a washing step is followed by several rinse steps during which a conventional rinse agent may be dispensed to aid sheeting and drying action.

Granular automatic dishwashing detergents of the present invention are as follows. Manufacturing methods are typical of those conventionally used to prepare granular cleaning products.

EXAMPLE I

| | % (wt.) | | |
|---|---|---|---|
| Ingredient | Formula A | Formula B | Formula C |
| Sodium citrate, dihydrate | 42.50 | 17.00 | 20.00 |
| Sodium carbonate or bicarbonate | 0.00 | 20.00 | 40.00 |
| Hydrated 2.0 ratio sodium silicate | 33.00 | 19.00 | 10.00 |
| 3500MW modified polyacrylate (active basis) | 4.00 | 6.00 | 8.00 |
| Nonionic surfactant | 1.50 | 3.50 | 5.00 |
| Sodium perborate or percarbonate | 5.00–10.00 | 5.00–10.00 | 5.00–15.00 |
| TAED | 3.50 | 0.00 | 3.50 |
| SAVINASE 6.0T | 2.20 | 2.00 | 1.00–3.00 |

-continued

| Ingredient | % (wt.) Formula A | Formula B | Formula C |
|---|---|---|---|
| TERMAMYL 60T | 1.50 | 1.10 | 0.50–1.50 |
| $C_{12}$ methoxypropyl glucosamide | 5.0 | 3.0 | 1.5 |
| Silicone-based suds suppressor | 2.0 | 1.0 | 0.5 |
| Perfume, dye, water and filler | | balance | |

EXAMPLE II

Use of $C_{12}$ Methoxypropyl Glucosamides as a Cleaning Agent in Automatic Dishwashing 4.5 g beef fat is melted onto each of four black melamine dinner plates. Two plates each are put on the bottom rack of a General Electric "potscrubber" automatic dishwasher. The wash program in both appliances uses 8 gpg water hardness and wash water selected for a peak wash temperature of 100/100° F. Into one appliance is loaded the manufacturer's recommended dose (both cups full) of a conventional commercial automatic dishwashing detergent. Into the second appliance is placed, at the start of the wash, sufficient $C_{12}$ methoxypropyl glucosamide to deliver a wash concentration of 500 ppm. A conventional silicone suds controlling agent is added, to ensure that foam levels remain low. At the end of the wash, the plates are taken out and compared. Plates from the conventional detergent wash have substantial fat residue with a white scum on the surface. Plates from the $C_{12}$ methoxypropyl glucosamide wash are spotlessly clean.

EXAMPLE III

The $C_{12}$ methoxypropyl glucosamide from the above example is substituted by a 90:10 blend of $C_{12}$/palm methoxypropylglueosamide. Excellent cleaning results are achieved and lower foam levels are observed, such that only 50 milligrams of silicone is capable of completely eliminating any residual foam. Moreover, an improved water sheeting action accompanies the good cleaning.

EXAMPLE IV

Use of $C_{12}$ Methoxypropyl Glucosamide as a Hard-Surface Cleaner or Dishwashing Cleaning Agent A solution in water is prepared consisting of 300 ppm of $C_{12}$ methoxypropyl glucosamide. Onto white polystyrene squares about 3 inches by 1 inch by 3 mm thickness are applied stripes of COVER GIRL lipstick, "Raspberry Rage" color. these stripes are about 1"×1.4" in size, one per coupon. The stripes, initially applied directly from the lipstick, are smoothed out to a uniform, dark pink consistency using a cotton bud. Two coupons are clipped onto the internal walls of a 250 ml beaker. To the beaker is added the cleaning solution. After stirring at ambient temperature using a magnetic stirrer for about 20 minutes, the coupons are removed and examined. Removal of lipstick is essentially complete. For comparison, when octadecyldimethylamine oxide, a good lipstick-removing surfactant, is substituted for $C_{12}$ methoxypropyl glucosamide in an otherwise identical trial, removal is incomplete and remains incomplete even when the temperature of the bath is raised to 120° F.

EXAMPLE V

An ADD composition whose compactness is 60% that of conventional ADD compositions (i.e., 40% reduction in usage levels) is as follows. The composition is designed for use at about 23.4 g per wash cycle (3,600 ppm in wash water).

| Ingredient | % (wt.) |
|---|---|
| Trisodium citrate[1] | 20.0 |
| Sodium bicarbonate | 20.0 |
| Nonionic surfactant[2] | 5.0 |
| Organic dispersant[3] | 4.0 |
| DTPA[4] | 2.44 |
| OXONE (% Av 0) | 15.0 (0.69) |
| TERMAMYL 60 T prill | 1.1 |
| SAVINASE 6.0 T prill | 2.0 |
| $Na_2SO_4/H_2O$/minors[5] | Balance |

[1]Trisodium citrate dihydrate, expressed on anhydrous basis.
[2]PLURAFAC LF 404, BASF Corp.
[3]Acrylate:maleate copolymer, sodium salt, m.w. 65,000.
[4]Diethylenetriamine pentaacetate, pentasodium salt.
[5]Maximum 8% wt. $H_2O$ in composition.

EXAMPLE VI

The composition of Example V is modified by removal of sufficient $Na_2SO_4$ to allow for the inclusion of 1% by weight of sodium perborate monohydrate. The resulting composition is useful in chlorinated water.

EXAMPLE VII

Use of a Long-Chain Methoxypropyl Glucamide (Palm Methoxypropyl Glucamide) to Improve Sheeting/Spreading of Water on Hard Surfaces Relevant to Automatic Dishwashing This Example serves to illustrate spreading rate effects of longer-chain glucosamides for water or oil on glass or polystyrene, which are expected to result in improved spotting/filming when the glucosamide is incorporated in an automatic dishwashing detergent.

1. Prepare a solution of 300 ppm palm methoxypropyl glucosamide concentration in water having hardness (as $Ca^{2+}$) of 6 U.S. grains per gallon and having pH=10. This solution is clear after being heated to 40° C. and recooling to room temperature.
2. Treat either a glass or a polystyrene surface with the solution of step 1 for 10 minutes.
3. Dry the glass or polystyrene surface with a kimwipe and wait one hour.
4. Place drops of water or mineral oil on the glass or polystyrene surfaces made by steps 1–3.
5. Compared with clean, untreated surfaces, an improved spreading rate of either water or mineral oil drops on the glass or polystyrene surfaces is observed.

Accordingly, the present invention also provides a so-called "rinse-aid" benefit which improves the appearance of hard surfaces such as dishes, glassware, tile, enamel finishes, and the like, by reducing spotting-filming on such surfaces. The benefit is achieved by contacting said surfaces with an aqueous solution comprising at least about 3 ppm, preferably about 15 ppm to about 500 ppm, of an N-alkoxy or N-aryloxy polyhydroxy fatty acid amide surfactant as described herein.

As noted hereinabove, it is preferred that the compositions and processes herein be substantially free from conventional straight-chain $C_{10}$–$C_{20}$ fatty acids such as lauric, myristic, palmitic, and the like, or their respective soaps, to avoid filming/spotting of the cleansed tableware. By "substantially free" herein is meant that the fatty acid is present in an amount no greater than about 1%, preferably no greater than about 0.3%, most preferably 0% of the compositions. Accordingly, it is preferred that any of the foregoing exemplified compositions be substantially free of such conventional fatty acids. Also, as noted hereinabove, the manufacture of the N-alkoxy and N-aryloxy polyhydroxy fatty acid amide surfactants can be conducted using the glyceride process which provides said surfactants with minimal, or no, contamination with fatty acids. Accordingly, it is also preferred that the foregoing exemplified compositions be manufactured using N-alkoxy or N-aryloxy polyhydroxy fatty acid amides made by the glyceride process.

However, it has been discovered that the compositions and processes herein can involve the use of branched-chain fatty acids which do not cause filming/spotting and which assist in cleaning. Such branched-chain fatty acids (typically present in the compositions in their salt, or "soap", form) are further exemplified by those of the formula $$R(CHR')(CH_2)_xCO_2M$$

wherein R is $C_1$–$C_{17}$ hydrocarbyl, R' is $C_1$–$C_{10}$ hydrocarbyl, x is 0–17 and M is a water-soluble salt-forming cation such as sodium, potassium, ammonium, triethanol ammonium, and the like. Substituents R and R' include alkyl, alkenyl or substituted alkyl and alkenyl, especially hydroxy-substituted. Such branched-chain materials include, but are not limited to, the water-soluble soaps of the following fatty acids: 2-methyl-1-undecanoic acid, 2-ethyl-1-undecanoic acid, 2-propyl-1-nonanoic acid, 2-butyl-1-octanoic acid, 2-pentyl-1-heptanoic acid, 3-propyl-1-decanoic acid, 4-propyl-1-octanoic acid, and mixtures thereof.

It is to be understood that while the branched-chain soaps are useful for improving the cleaning performance of the present compositions, they may tend to cause excessive sudsing in automatic dishwashing machines. Such sudsing may be controlled by means of various known suds suppressors. However, lower inherent sudsing may be achieved by selecting branched soaps having a total of at least about 12, preferably at least about 14, carbon atoms in their molecular structure. Branched soaps useful herein such as sodium 2-heptyl-1-undecanoate are described, for example, in Japanese 88-327433; CA reference 113(24):214340m. The following exemplifies a composition of the present type which comprises the above disclosed ingredients and from about 0.1% to about 10%, by weight, of a water-soluble, branched-chain soap.

EXAMPLE VIII

The Formula A, B and C compositions of Example I are modified by the inclusion therein of 0.1%, 2.0% and 10%, respectively, of sodium 2-heptyl-1-undecanoate or 2-methyl-1-undecanoate to provide ADD compositions with high grease removal properties.

What is claimed is:

1. A method for reducing spotting/filming on tableware surfaces, comprising rinsing said surfaces with an aqueous medium containing at least about 15 ppm of an N-alkoxy or N-aryloxy polyhydroxy fatty acid amide surfactant.

* * * * *